US005897767A

United States Patent [19]

Patel

[11] Patent Number: 5,897,767

[45] Date of Patent: Apr. 27, 1999

[54] COMPOSITION AND PROCESS FOR THE TREATMENT AND RECOVERY OF OIL SLUDGE

[76] Inventor: Girish Patel, Yogi Krupa Ground Floor Shanti Nagar Society, Opp. Ajit Nagar Baroda-390 007, India

[21] Appl. No.: 08/770,836

[22] Filed: Dec. 20, 1996

[51] Int. Cl.[6] ..... C10G 29/00

[52] U.S. Cl. ..... 208/13; 252/358; 502/150; 502/324; 502/325; 502/340

[58] Field of Search ..... 208/13; 252/358; 502/150, 324, 325, 340

[56] References Cited

U.S. PATENT DOCUMENTS

| | | | |
|---|---|---|---|
| 4,233,174 | 11/1980 | Sheridan | 252/170 |
| 4,316,806 | 2/1982 | Canevari | 210/708 |
| 4,442,014 | 4/1984 | Looney et al. | 252/8.55 C |
| 4,751,005 | 6/1988 | Mitsui et al. | 210/759 |
| 4,812,225 | 3/1989 | Corti et al. | 208/13 |
| 4,834,775 | 5/1989 | Rodriguez et al. | 44/51 |
| 4,981,579 | 1/1991 | Paspek et al. | 208/13 |
| 5,085,710 | 2/1992 | Goss | 134/22.14 |
| 5,552,063 | 9/1996 | Yan | 210/763 |

*Primary Examiner*—Walter D. Griffin
*Assistant Examiner*—Nadine Preisch
*Attorney, Agent, or Firm*—John L. Isaac

[57] ABSTRACT

A chemical composition is disclosed for use in the treatment and dissolution of oil sludge. The composition includes an anionic surfactant and a nonionic surfactant. In addition, a wetting agent is included along with an aromatic hydrocarbon carrier. Finally, an effective amount of a catalyst activator is included.

30 Claims, 3 Drawing Sheets

COMPOSITION AND PROCESS FOR THE TREATMENT AND RECOVERY OF OIL SLUDGE

Background of The Invention

1. Field of the Invention

This invention relates, generally, to techniques for cleaning sludge deposits from oil storage tanks and, more particularly, to a chemical formulation and process of achieving the same. Specifically, the present invention relates to a chemical formulation for breaking the interfacial bonds between the various components of oil sludge and a process for utilizing the same.

2. Description of the Prior Art

In general, petroleum-containing sludges, hereafter referred to as oil sludges, are made up of three main constituents, that is water, petroleum and sludge solids. Such sludge solids include wax, tar, resins, biological material, metals and the like. The fuel oils used today differ from those used only a number of years ago in that the present refining processes demand the reprocessing of what was the formerly final products. Today's oil products are cracked at very high temperatures or pressures so as to obtain higher yields of the lighter distillates. The final residues or fuel oils, as the result of this treatment, contain compounds which are unstable. They separate as tar, gum, and the like combined with condensates to form sludge. Such oil sludges arise in petroleum production, as residual tanker sludge in transporting crude oil, as tank residues when storing the crude oil, and in the processing of crude oil.

The build up of oil sludge is a problem in that the referenced impurities of oil sludge interfere with the free-flow of oil and clog up fuel lines, screens and burner tips. Sludge builds up with each load of oil put into a tank and, if allowed to go unchecked, will result in poor atomization of fuel, reduction of storage tank capacity and eventual blockage of the tank's discharge lines. Such oil sludge wastes fuel, causes unnecessary shut down and reduces boiler efficiency.

As a result of this, oil tanks are periodically cleaned to repair leaks in the tank floor, steam coils, and roof drains. They are also cleaned to facilitate removal or repair of sunken roofs as well as to recover storage capacity and eliminate crude oil tank unit upsets. Crude oil unit upsets are generally caused by the pluggage of suction lines to the crude charge pumps, slugs of water due to pluggage of the tank water draw, or slugs of solids because of the high sludge levels in the tank. Additionally, clean storage tanks can be inspected and maintained to prevent any environmental damage.

Currently, there are two principal manners of cleaning tanks. The first is a mechanical cleaning program whereby agitation, movement and physical separation are typical components of the process. U.S. Pat. No. 2,065,462 discloses such a technique. Usually, the sludge must be removed from the tank before implementing a hydrocarbon recovery method. Removal presents quite an obstacle if the sludge is asphaltic, very compact or not fluid. Moreover, once the sludge is removed, it must still be treated to recover the hydrocarbons. External recovery systems include belt presses, hot pits, centrifuges and portable storage tanks which allow separation. These techniques, however, are generally not very efficient and do not recover all the hydrocarbons, leaving residual amounts in the solids which may classify them still as hazardous. Thus, hazardous waste disposal is reduced, but not eliminated. Mechanical methods can also impact tank integrity, thereby risking odor nuisances, vapor release and soil contamination.

A second primary technique for cleaning oil tanks involves a chemical method. Currently, Federal environmental laws regulating waste disposal provide incentive for efficient chemical methods for cleaning storage tank. U.S. Pat. No. 4,233,174, U.S. Pat. No. 4,417,976, U.S. Pat. No. 5,039,450 and U.S. Pat. No. 5,085,710 all disclose such techniques, while U.S. Pat. No. 4,293,348 and U.S. Pat. No. 5,031,648 relate to the chemical treatment of petroleum materials.

Many standard tank cleaning methods, however, are ineffective in minimizing wastes to meet Federal standards. These methods include manual removal of sludge by workers inside the tank, mechanical removal by front-end loader which necessitates cutting a hole in the tank's side for entry, removal by remote control dredging devices, removal by power spray nozzles and removal by circulating hot oil through the tank. In addition, as is indicated above, none of these methods in and of themselves recovers clean hydrocarbons from the sludge. To the contrary, the sludge, after it is removed, must be taken elsewhere for such hydrocarbon recovery.

Thus, while cleaning methods meeting Federal environmental regulations for the treatment of oil sludge have been devised, there is still a need for a chemical method which treats the oil sludge in situ by separating it into its major component parts, that is water, hydrocarbons and solid sludge residue, which in turn can be directed to their own separate storage tanks and uses. While such techniques may exist as indicated in the referenced patents, it is desired to accomplish this is a relatively short period of time to eliminate false readings, and such prior techniques require large tank down times to accomplish the cleaning.

SUMMARY OF THE INVENTION

Accordingly, it is one object of the present invention to provide a chemical composition useful in the treatment and dissolution of oil sludge.

It is another object of the present invention to provide a chemical composition having a catalyst activator for enhancing the break up of interfacial bonds between the components of oil sludge.

Still another object of the present invention is to provide a process for the treatment and removal of oil sludge deposits in oil tanks utilizing an improved chemical composition while significantly shortening the time required for such tank cleaning.

To achieve the foregoing and other objects and in accordance with the purposes of the present invention, as embodied and broadly described herein, a chemical composition is disclosed for use in the treatment and dissolution of oil sludge. The composition includes an anionic surfactant and a nonionic surfactant. In addition, a wetting agent is included along with an aromatic hydrocarbon carrier. Finally, an effective amount of an organic catalyst activator compound is included.

This composition is utilized in a process for the treatment and dissolution of oil sludge deposited in an oil storage tank. First, the oil level in the tank is lowered to the level of the oil sludge, and then a hydrocarbon solvent is added to the tank in an amount approximately equal to the sludge. The chemical composition described above is then injected into the tank to break the interfacial tension between components of the sludge. The chemical composition, sludge and hydrocarbon solvent are then circulated through the tank to form a sludge mixture while applying heat to thoroughly mix the chemical composition with the sludge to remove the sludge from the inner surfaces of the tank. Circulation of the sludge mixture is then terminated, and the sludge mixture is allowed to settle and form a hydrocarbon layer, a water layer and a solids layer. The hydrocarbon layer and the water layer are separately transferred to separate containers, while the remaining solids are removed from the tank.

Brief Description of the Drawings

The accompanying drawings which are incorporated in and form a part of the specification illustrate preferred embodiments of the present invention and, together with a description, serve to explain the principles of the invention. In the drawings.

Detailed Description of the Preferred Embodiments

The chemical compositions of the present invention dissolves crude oil sludge in petroleum refinery and pipeline oil storage tanks, as well as tanker ships, and converts the sludge into crude oil, water and residual mud and muck. It is a liquid additive that disperses the sludge by lowering the interfacial tension between sludge and oil, resulting in a homogeneous mixture throughout which, in effect, converts the sludge into useful fuel. The composition of the present invention is environmentally friendly and eliminates the manual cleaning of sludge from such tanks. The entire sludge volume in these tanks is dissolved, and residual mud is easily removed from the tank thereby enabling the tank to be ready for recommission and use within a matter of 15 days or less.

Figure 1:
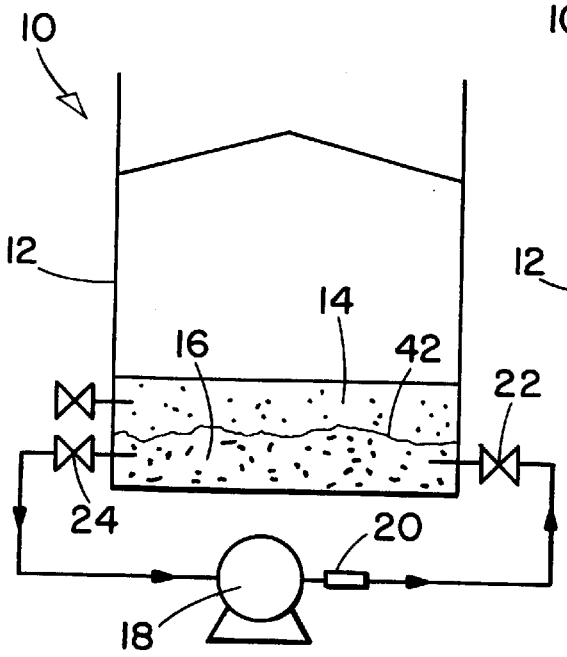
FIG. 1 is a schematic of an oil storage tank illustrating the circulation flow of the process of the present invention as well as illustrating tank constituents before and after treatment with the chemical composition of the present invention.
Figure 1A:
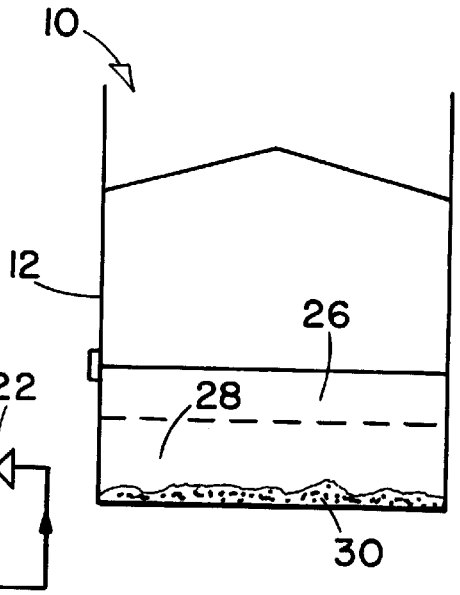

To better understand the invention, reference will first be made to FIGS. 1–3. In these figures, a typical oil refinery or storage tank 10 includes a container 12 which stores crude oil 14. Over time, oil sludge 16 builds up in the bottom of the tank 10. The sludge 16 is formed, in part, by the presence of tar, gums, resins, asphaltenes, biological growth and water present in the fuel oil 14. As previously discussed, these impurities can interfere with free flow of oil and clog up fuel lines, screens and burner tips. If the sludge build up 16 is allowed to go unchecked, it will result in reduction of storage tank capacity and eventual blockage of discharge lines. Moreover, the sludge 16 will build up whether it is in a tank 10 or the bottom of a tanker ship, a storage lagoon or the like.

To dissolve the sludge 16 utilizing the chemical composition of the present invention, a pump 18 is provided for circulating the chemical composition through a venturi 20 into the container 12 at input connection 22. The composition is mixed in with the sludge 16 so as to thoroughly admix therewith. The sludge and chemical composition is recirculated to pump 18 by directing the sludge mixture to an output valve 24, back through the pump 18 and then reintroduced through the input valve 22, as discussed in greater detail below. Once the sludge 16 has been treated with the chemical composition of the present invention, the resultant tank components include a top hydrocarbon layer 26 which floats on an intermediary water layer 28. Thus, the hydrocarbon oil components of the sludge 16 are separated from the particulate mud material 30 and made available as additional fuel products. Once the layers 26, 28 and 30 have been formed, the subsequent cleaning of the container 12 becomes relatively easy as discussed below.

As previously indicated, there are numerous chemical treatment processes presently available in the art and the objectives of such chemical cleaning processes are generally the same as the process and composition of the present invention, i.e. to recover hydrocarbon materials from the sludge, and then separate such hydrocarbons and resultant water from the residual solids. Moreover, it is highly desirable to remove a sufficient amount of hydrocarbons from the solids 30 so that the residual solids layer 30 is not considered environmentally hazardous for disposal purposes. Typical prior art chemical cleaning compositions usually take between three and four weeks to accomplish the cleaning of an oil tank, while the present invention only takes approximately 8–15 days for reasons discussed below.

In preferred form, the composition of the present invention includes an anionic surfactant, a nonionic surfactant, a wetting agent, an aromatic hydrocarbon solvent carrier, and an activator consisting of an organic catalyst. The key factor which enables the present invention to be so effective in dissolving oil sludge by lowering the interfacial tension between sludge components and hydrocarbons therein is the incorporation of a catalyst activator as a part of the chemical composition. It is unclear how the catalyst functions within the chemical composition of the present invention. However, in preferred form the catalyst of the present composition is an organic transition metal preferably selected from organic cadmium, cobalt and manganese. Most preferably, the catalyst of the composition is organic manganese preferably present in the composition at about 5–10 ppm.

In preferred form, the anionic surfactant is selected from the oxyalkylates and, most preferably, is diodyle sodium sulphosuccinate. However, any of the sulfur containing anionic surfactants known to the art may be utilized with the present composition. In addition, the nonionic surfactant of the composition of the present invention is preferably a derivative of ethylene oxide and, more preferably, is selected from any of the ethoxylated nonylphenols. In addition to the surfactants discussed above, the chemical composition of the present invention also preferably includes a wetting agent. The preferred wetting agent includes the napthanates and, more preferably, is tridecyl alcohol.

The catalysts along with the surfactants and wetting agent need to be carried or some way transported to the oil sludge. To accomplish this, a hydrocarbon carrier is preferably utilized as part of the composition. In preferred form, the hydrocarbon carrier includes heavy aromatic distillates as well as benzene compounds. However, any aromatic hydrocarbon solvent capable of dissolving the remaining components of the composition may be utilized in the composition of the present invention.

In preferred form, the individual surfactants and wetting agent of the composition of the present invention may each vary from 5–25 weight percent of the composition according to the sludge quality and quantity. This variability in weight percentages of each of these constituents is due to the fact that oil produced from different locations around the world have differing components such as wax or gum, tar (ashphalate), resins, biological growth, metals, water and the like. These components of crude oil may vary dramatically from location to location around the globe. For example, some have more wax while some have more coal tar, and so on. Specifically, the amount of tar and wax in a particular crude oil is especially important in order to determine the amount of chemical components necessary to loosen the interfacial bonds between the various components of the oil. Thus, depending upon the amount of tar and wax in a particular crude oil, the amount of the anionic and nonionic surfactants and wetting agent may increase or decrease relative to the amount of hydrocarbon carrier. The preferred chemical composition of the subject invention is as follows:

| | | |
|---|---|---|
| anionic surfactant | oxyalkylates | trace amounts |
| nonionic surfactant | ethylene oxide derivatives | 1–5% |
| wetting agent | napthanates | 10–15% |
| hydrocarbon carrier | heavy aromatic distillates | 80–90% |
| hydrocarbon carrier | benzene compounds | 10–15% |
| catalyst | organic transition metals | 5–10 ppm |

Referring back to FIGS. 1–4, the method of the present invention for dissolving oil sludge into its hydrocarbon, water and solid constituent parts, in both storage tanks and lagoons, includes injecting the chemical composition of the present invention into the oil sludge container 12 and then circulating it so as to thoroughly admix the composition with the sludge to remove the sludge from the container surfaces. In one preferred form as illustrated in FIG. 2, a container 12 may have two recirculation systems 32 and 33 each of which includes a pump 18 and venturi 20 for injecting the chemical composition into the recirculation lines 34. In this manner, the sludge within the container 12 is continuously admixed and moved throughout the container 12 by the dual recirculation systems 32 and 33. FIG. 3 illustrates an example of a venturi 20 utilized to inject the composition of the present invention from a container 36 holding such composition into the recirculation line 34. In another view of this embodiment of the present invention, illustrated in FIG. 4, the container 12 includes an upper out take pipe 38 which is connected to the pump 18 which directs the sludge mixture through the pipe 34 back into the container 12. The composition of the present invention is directed to the pipe 34 from the container 36 by way of venturi line 40.

In preferred form, the method of the present invention starts by removing the crude oil 14 from the container 12 down to the level 42 of the sludge 16. Then, an inexpensive hydrocarbon solvent is preferably added to the container 12 in a volume approximately equal to the volume of the sludge 16. This particular hydrocarbon solvent may be selected from any type of inexpensive aromatic including kerosene, diesel oil, heating oil, light oil and the like. The purpose of this solvent is to provide sufficient liquid volume to permit circulation of the sludge 16 in conjunction with the chemical composition of the present invention injected into the container 12. Once the inexpensive solvent has been added to the container 12, an effective amount of the chemical composition of the present invention is then injected into the container 12 for admixture with the sludge 16. In preferred form, approximately 0.4–0.5 weight percent of chemical composition is utilized relative to the weight of the sludge in the container 12. As previously described, the various weight percentages of the chemical constituents of the composition of the present invention will vary depending upon the quality of the crude oil 14 which, in turn, varies depending upon location of crude oil extraction from around the world.

Regardless of the mechanical pumping system utilized to achieved recirculation of the sludge and chemical composition mixture, the recirculation system and pumps thereof are started. As the sludge and the originally added hydrocarbon solvent start circulating through the tank 12 and the recirculation system, the chemical composition of the present invention is injected through the venturies to disperse and activate separation of oil from the sludge. Moreover, it will act to strip the sludge from the surfaces of the tank. The released hydrocarbons will be carried to the top of the liquid within the container 12 with the added solvent. In addition, water may be added if required for washing effect and also to raise the hydrocarbon level within the container 12. In preferred form, the material within the container 12 may be heated in order to liquefy the remaining sludge in the bottom of the tank 12. Unlike prior techniques, however, the maximum heat needed in the present invention is only about 60–70° C., which may be achieved by employing any available conventional heating technique. The recirculation of the sludge, hydrocarbon solvent and chemical composition mixture is preferably maintained for up to a maximum of about fifteen hours, or until the sludge is entirely removed from the surfaces of the container vessel 12, whichever fist occurs. Upon inspection, once the tank surfaces are found to be free from sludge, the circulation is stopped, and the mixture in the tank 12 is allowed to settle for approximately 12 hours. Once this settling has occurred, three distinct layers are formed as illustrated in FIG. 1, that is the hydrocarbon layer on the top, the water in the intermediate layer and a solid or mud layer at the bottom. However, the mud layer is generally substantially free of oil and therefore does not adhere or stick to the surface of the container vessel 12. Moreover, it meets environmental standards as a non-hazardous material for eventual disposal.

The hydrocarbon layer 26 is then transferred to a crude unit for continued used in refining. Once the hydrocarbon layer 26 has been removed, the water layer 28 is off loaded gradually, preferably to an API system. In preferred form, the water sample is tested for TLC, $NH_3$, and COD and other contaminants as required. The residual mud solids 30 may be simply removed from the container 12 by flushing with a water jet, vacuum suction or manually scooping it out.

When comparing the prior manual removal of sludge, which is a frequently used technique, with sludge dissolution and removal utilizing the chemical composition and process of the present invention, the present invention has many advantages. First, the manual technique removal takes an oil storage tank out of operation for many months and requires approximately 40–60 days utilizing 30–50 manual workers in a prohibitive hazardous area in an oil installation for which special checks are carried out. The present invention can be utilized to clean a tank in 15 days or less utilizing no more than 5 individuals. Utilizing the manual technique for removing sludge, crude oil is not recovered from the sludge stored in tanks or lagoons, and instead is often sold. There are also evaporation losses of hydrocarbons. Utilizing the composition and process of the present invention, however, a minimum of 85% up to 99% of the crude oil is recovered from the sludge. Moreover, sludge lagoons are no longer necessary utilizing the process and composition of the present invention, thereby providing significant environmental advantages. Finally, when the manual process is utilized to clean out sludge, the bottom, side plates and drain outlets of such tanks are frequently corroded during the lengthy time period the tank is made idle, therefore frequently requiring repair and maintenance to the tanks. Thus, tanks can be out of operation for approximately 4–8 months utilizing prior manual techniques, whereas the composition and process of the present invention enables the entire sludge in an oil tank to be dissolved and removed in no more than 15 days. This avoids the corrosion problem and loss of operation of the oil tank for significant periods of time.

EXAMPLE I

Figure 2:
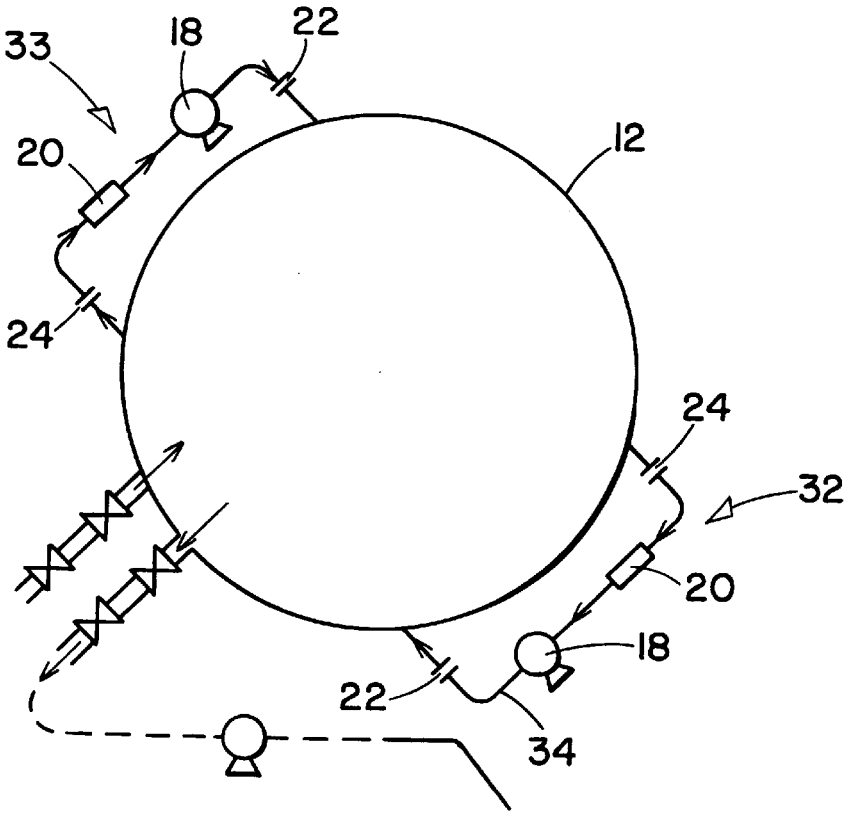
FIG. 2 is a top schematic of one tank circulation arrangement utilized to adapt the tank to the process of the present invention.
Figure 3:
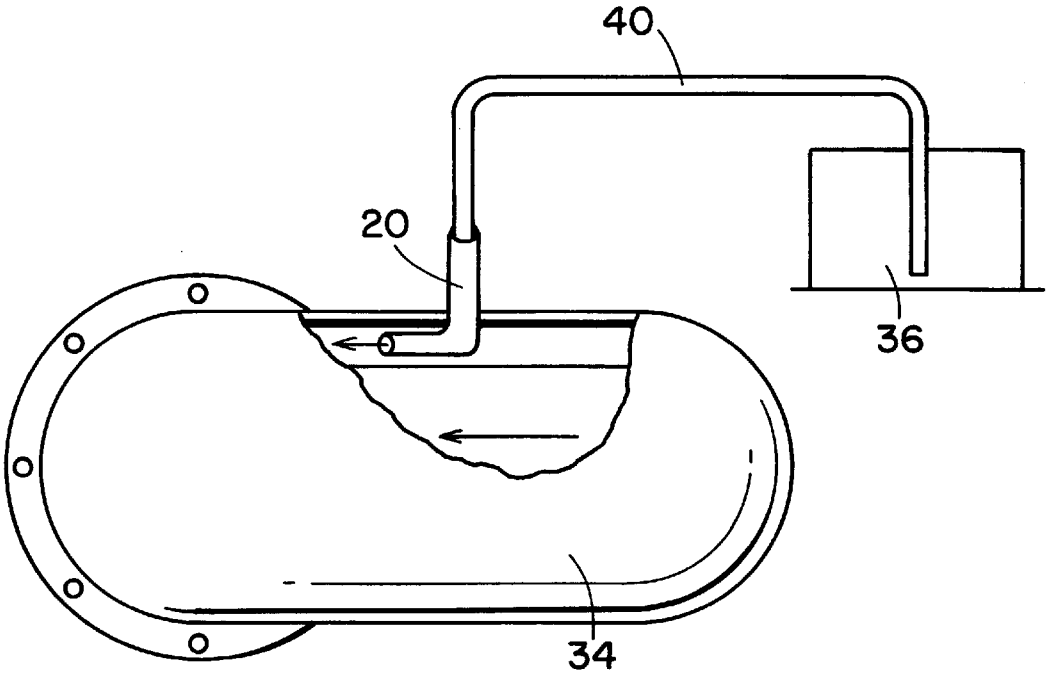
FIG. 3 is a schematic illustrating the chemical composition injection step of the process of the present invention.
Figure 4:
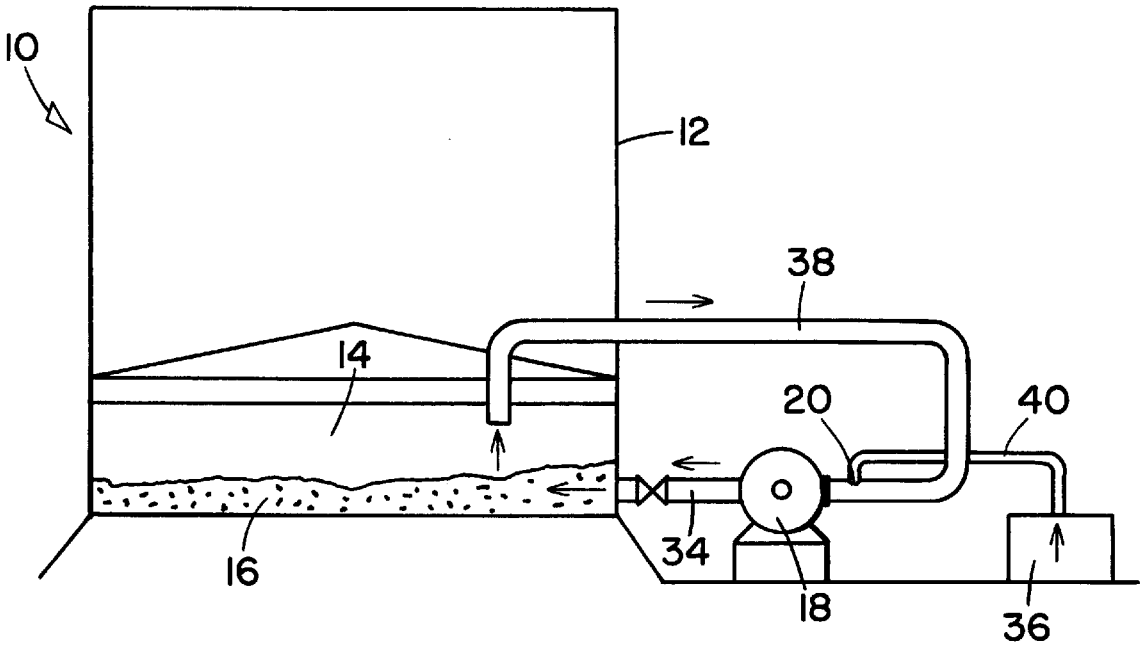
FIG. 4 is a side schematic of the arrangement illustrated in FIG. 2 for the circulation step of the process of the present invention.

In this trial test example, a 65,000 kl black crude oil tank as illustrated in FIGS. 2 and 4 was utilized to test the composition and process of the present invention. This tank included approximately 1,000 tons of waxy asphaltic dry sludge in the bottom of the tank. The machinery used to accomplish mixture recirculation included 20 horse power electric motors and a 6" screw pump with necessary pipeline as illustrated in FIGS. 2 and 4.

Figure 5:
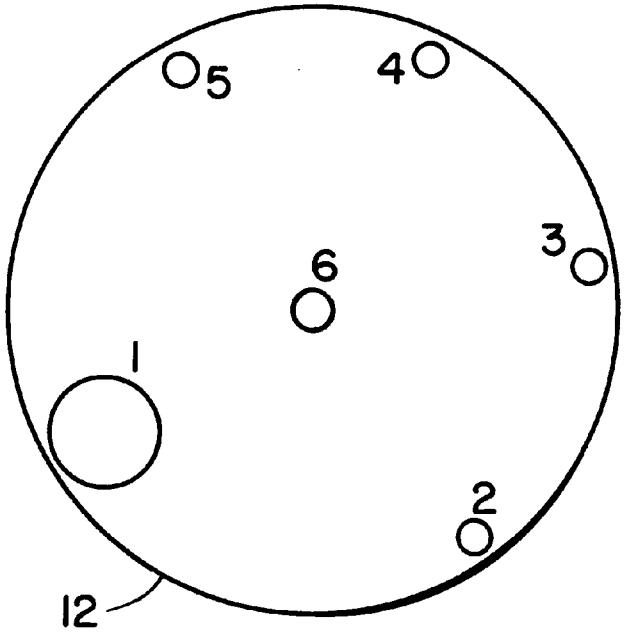
FIG. 5 is a schematic illustrating the arrangement for tank sampling in one test of the composition and process of the present invention.

This tank was initial filed with black crude oil bringing a level to 24" pipe for soaking the sludge for 15 days prior to the trial. After this initial soaking, the black crude was lowered to the sludge level, and gas oil was added as the initial inexpensive solvent. Then, approximately 4,000 kg of the preferred chemical composition of the present invention was injected into the tank, and circulation was provided utilizing the system illustrated in FIG. 2 and 4 and as discussed above. This recirculation with the chemical composition of the present invention was carried on for approximately 28 hours. Intermittently, the sludge position was checked to determine the progress of the chemical on the sludge. Once the 28 hour circulation period was complete, the amount of sludge was measured at six different positions, points 1–6 illustrated in FIG. 5. In each of these six different positions in the tank, less than 1 mm of sludge remained. Thus, it was determined that the entire amount of sludge in the tank had been dissolved. The mixture was then allowed to settle, and the various levels removed. Approximately $120,000.00 of residual hydrocarbon oil was recovered from the sludge in this tank.

EXAMPLE II

Figure 6:
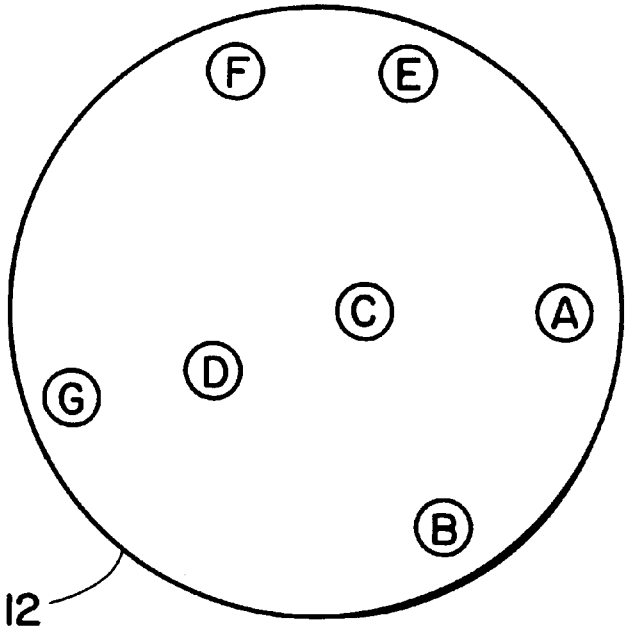
FIG. 6 is a top schematic illustrating tank sludge testing points in a second example of testing of the composition and process of the present invention.

Referring to FIG. 6, a 5,000 kl capacity tank was utilized in this particular test procedure. The initial sludge in the tank was calculated about approximately 500 metric tons. Such volume was first measured before addition of the chemical composition of the present invention at seven different points along the tank 12 and are designated as points A–G in FIG. 6. The results of these samples are provided in Table I. These samples were taken after the initial addition of a gasoil solvent in an amount substantially the same as the sludge.

TABLE I

| Point | Temp ° C. | Sp. Gr. | Total Dip | Sludge Dip | Water Level |
|---|---|---|---|---|---|
| A | 41 | 0.825 | 43 | 26 | nil |
| B | 41 | 0.819 | 43 | 26 | nil |
| C | 41 | 0.805 | 46 | 25 | nil |
| D | 41 | 0.809 | 48 | 26 | nil |
| E | — | — | 32 | 32 | nil |
| F | — | — | 42 | 35 | nil |
| G | — | — | 49 | 26 | nil |

TABLE II

| Point | Temp ° C. | Sp. Gr. | Total Dip | Sludge Dip | Water Level |
|---|---|---|---|---|---|
| A | 37 | 0.910 | 59 | 0 | 24 |
| B | 37 | 815 | 65 | 10 | 32 |
| C | 35 | 865 | 57 | 0 | 35 |
| D | 36 | 868 | 69 | 0 | 33 |
| E | 35.5 | 879 | 75 | 0 | — |
| F | — | — | 70 | 0 | — |
| G | 36.5 | 880 | 65 | 5 | — |

Then, the preferred chemical composition of the present invention was injected into the tank 12 using the guidelines previously described. Recirculation of the composition/sludge mixture was then carried out for about nine hours a day for six consecutive days. After the sixth day, circulation was ceased, and samples of the sludge mixture were collected. The results of these collections are illustrated in Table II. As can be seen from Table II, virtually all of the sludge had been removed from the tank 12.

EXAMPLE III

A 20,000 cubic meter tank was utilized in this particular test. The tank manhole was opened, and an initial sludge volume of 22–25 cms was determined at the tank bottom. This represented about 300 metric ton of sludge. Gasoil was then added to the tank up to about 130 cms, and the temperature was raised to approximately 76° C. Circulation was commenced for two days. Once this two day circulation ceased, a sludge sample was taken, and the sludge sample at the tank bottom was 37 cms. At this juncture, 1,200 kgs of the preferred chemical composition of the present invention was added to the tank, and circulation was continued without raising the temperature. This circulation with the preferred chemical composition of the present invention was continued for three days, with the temperature being maintained at about 69° C. Once the circulation was stopped, the layers were allowed to settle. The final sludge dip was 2–5 cms as opposed to the initial sludge dip of 22–25 cms. Moreover, 273 metric tons of hydrocarbon material were recovered from 300 metric tons of initial sludge, leaving only 27 metric tons of solids. This resulted in a 99% hydrocarbon recovery from the oil sludge in this tank utilizing the preferred chemical composition and process of the present invention.

As can be see from the above, the preferred chemical composition and process of the present invention is an environmentally friendly composition and process which eliminates manual cleaning of sludge from oil tanks. The many advantages of the present invention include the fact that no sludge lagoon is required, and it avoids an idle period of any significance for the storage tanks. Moreover, there is no detrimental effects on the environment, and in fact the present invention enables substantial recovery of up to 99% of the hydrocarbons in the oil sludge. This also provides a significant financial advantage. Spillage of sludge on roads is avoided as well as eliminating fire hazards and human accidents commonly found in the manual removal of sludge. Moreover, the components of the chemical composition of the present invention are relatively inexpensive, and can certainly be recovered from the profits realized due to the recovery of hydrocarbon oil from the oil sludge. The present invention is a significant financial and environmental enhancement to the recovery of oil sludge from oil tankers and oil containers as compared to existing systems or processes.

The foregoing description and the illustrative embodiments of the present invention have been described in detail in varying modifications and alternate embodiments. It should be understood, however, that the foregoing description of the present invention is exemplary only, and that the scope of the present invention is to be limited to the claims as interpreted in view of the prior art. Moreover, the invention illustratively disclosed herein suitably may be practiced in the absence of any element which is not specifically disclosed herein.

I claim:

1. A chemical composition for use in the in-situ treatment and dissolution of oil sludge comprising:

an anionic surfactant;

a nonionic ethylene oxide derivative surfactant;

a wetting agent;

an aromatic hydrocarbon solvent carrier; and a non-oxidizing activator consisting of an organic catalyst containing a transition metal.

2. The composition as claimed in claim 1, wherein said organic transition metal catalyst is selected from the group consisting of cadmium, cobalt and manganese.

3. The composition as claimed in claim 2, wherein said transition metal catalyst comprises organic manganese.

4. The composition as claimed in claim 1, wherein said anionic surfactant comprises an oxyalkylate.

5. The composition as claimed in claim 1, wherein said nonionic surfactant is selected from ethoxylated nonylphenols.

6. A chemical composition for use in the in-situ treatment and dissolution of oil sludge comprising:

an anionic surfactant;

a nonionic surfactant;

a wetting agent;

an aromatic hydrocarbon carrier; and an effective amount of a non-oxidizing catalyst activator for breaking interfacial tensions between components of the oil sludge in combination with said surfactants and wetting agent, said catalyst activator comprising an organic transition metal compound.

7. The composition as claimed in claim 6, wherein said transition metal compound is selected from the group consisting of cobalt, cadmium and manganese.

8. The composition as claimed in claim 7, wherein said catalyst comprises organic manganese.

9. The composition as claimed in claim 6, wherein said anionic surfactant comprises an oxyalkylate.

10. The composition as claimed in claim 9, wherein said anionic surfactant is diodyle sodium sulphosuccinate.

11. The composition as claimed in claim 6, wherein said nonionic surfactant comprises an ethoxylated nonylphenol.

12. The composition as claimed in claim 6, wherein said wetting agent comprises napthanate.

13. The composition as claimed in claim 6, wherein said wetting agent is tridecyl alcohol.

14. The composition as claimed in claim 6, wherein said aromatic hydrocarbon solvent includes heavy aromatic distillates and benzene compounds.

15. A chemical formulation for use in breaking interfacial tensions between components of oil sludge for the in-situ treatment and dissolution of the oil sludge, said formulation comprising:

an anionic oxyalkylate surfactant;

a nonionic surfactant derived from ethylene oxide;

a napthanate wetting agent;

a carrier solvent of aromatic hydrocarbons; and an amount of a non-oxidizing organic transition metal catalyst effective for activating said formulation outside the added presence of oxygen.

16. The formulation as claimed in claim 15, wherein said carrier solvent comprises heavy aromatic distillates.

17. The formulation as claimed in claim 16, wherein said carrier solvent further comprises benzene compounds.

18. The formulation as claimed in claim 15, wherein said catalyst comprises organic manganese.

19. The formulation as claimed in claim 15, wherein each said anionic surfactant, said nonionic surfactant and said wetting agent are each present in said composition in an amount of 5–25% by weight.

20. The formulation as claimed in claim 19, wherein said aromatic hydrocarbon carrier solvent is present in approximately 80–90% by weight.

21. The formulation as claimed in claim 15, wherein the concentration of said catalyst is 5–10 ppm.

22. A chemical composition for use in the dissolution of oil sludge and including anionic and nonionic surfactants, a wetting agent, and a hydrocarbon carrier, the improvement wherein said composition further includes a non-oxidizing activator in the form of an organic metal catalyst adapted for the in-situ dissolution of oil sludge.

23. The chemical composition of claim 22, wherein said catalyst is present in said composition in approximately 5–10 ppm.

24. The chemical composition of claim 22, wherein said catalyst is selected from the group consisting of cobalt, cadmium and manganese.

25. The chemical composition of claim 24, wherein said catalyst comprises organic manganese.

26. A process for the in-situ treatment and dissolution of oil sludge deposited in an oil storage tank having an inner surface, said process comprising the steps of:

lowering any oil level in said tank to the level of said sludge;

adding a hydrocarbon solvent to said tank in an amount approximately equal to said sludge;

injecting a chemical composition into said tank to break interfacial tension between components of said sludge, said chemical composition including anionic and nonionic surfactants, a wetting agent, an aromatic hydrocarbon carrier and a non-oxidizing organic transition metal catalyst to activate said composition;

circulating said chemical composition, sludge and hydrocarbon solvent through said tanks to form a sludge mixture while applying heat to thoroughly mix said chemical composition with said sludge to remove said sludge from the inner surface of said tank;

terminating said circulation and allowing said sludge mixture to settle and form a hydrocarbon layer, a water layer and a solids layer;

separately transferring said hydrocarbon layer and said water layer to separate containers; and removing the remaining solids from said tank.

27. The process as claimed in claim 26, wherein said sludge mixture is heated to approximately 60–70° C. during the circulation of said sludge mixture.

28. The process as claimed in claim 26, wherein the amount of chemical composition injected into said tank is approximately 0.4–0.5 weight percent relative to the weight of said sludge.

29. The process as claimed in claim 26, wherein said sludge is circulated while being heated for up to 24 hrs. until the surfaces of said tank are free from said sludge.

30. The process as claimed in claim 29, wherein once the circulation of said sludge mixture is terminated, the sludge mixture is allowed to settle approximately 12 hrs to form said separated layers.

* * * * *